US006017689A

United States Patent [19]

Bell et al.

[11] Patent Number: 6,017,689

[45] Date of Patent: Jan. 25, 2000

[54] COLOR PHOTOGRAPHIC SILVER HALIDE MATERIAL

[75] Inventors: Peter Bell, Köln; Ralf Büscher, Lohmar; Lothar Endres, Bergisch Gladbach; Lothar Rosenhahn; Rainer Scheerer, both of Köln; Lydia Simon, Wülfrath; Thomas Stetzer, Langenfeld, all of Germany

[73] Assignee: Agfa-Gevaert AG, Leverkusen, Germany

[21] Appl. No.: 09/156,506

[22] Filed: Sep. 17, 1998

[30] Foreign Application Priority Data

Sep. 24, 1997 [DE] Germany ..... 197 42 040

[51] Int. Cl.[7] ..... G03C 1/46

[52] U.S. Cl. ..... 430/504; 430/506; 430/543; 430/502; 430/503

[58] Field of Search ..... 430/504, 506, 430/543, 502, 503, 557, 556, 552, 553, 558

[56] References Cited

U.S. PATENT DOCUMENTS

| | | | |
|---|---|---|---|
| 4,184,876 | 1/1980 | Eeles et al. | 430/505 |
| 4,526,863 | 7/1985 | Mihayashi et al. | 430/506 |
| 4,652,515 | 3/1987 | Ogawa et al. | 430/506 |
| 4,977,069 | 12/1990 | Iijima et al. | 430/506 |
| 5,830,628 | 11/1998 | Borst et al. | 430/506 |

FOREIGN PATENT DOCUMENTS

| | | |
|---|---|---|
| 731383 | 2/1996 | European Pat. Off. . |

*Primary Examiner*—Geraldine Letscher
*Attorney, Agent, or Firm*—Connolly Bove Lodge & Hutz LLP

[57] ABSTRACT

A color photographic silver halide material having at least two blue-sensitive, yellow coupler containing silver halide emulsion layers, at least two green-sensitive, magenta coupler containing silver halide emulsion layers and at least two red-sensitive, cyan coupler containing silver halide emulsion layers together with conventional interlayers and protective layers, wherein photosensitive layers of identical color sensitivity differ with regard to the photographic sensitivity thereof and the more highly sensitive layers are arranged further away from the support than the less sensitive layers of identical color sensitivity, which material contains, in a layer which is arranged further from the support than the most highly sensitive, blue-sensitive layer, both at least one yellow coupler and at least one magenta or cyan coupler, is distinguished by improved grain and sensitivity combined with very good color reproduction.

2 Claims, No Drawings

COLOR PHOTOGRAPHIC SILVER HALIDE MATERIAL

This invention relates to a colour photographic recording material having improved grain and sensitivity combined with very good colour reproduction.

It is known that false colour couplers are added to at least one blue-sensitised silver halide emulsion layer in order to improve colour reproduction. "False colour couplers" are here taken to denote colour couplers which, by coupling with the developer oxidation product, produce a dye which is not complementary to the spectral sensitisation of the layer concerned.

Preferably, cyan couplers are used in low sensitivity, blue-sensitised emulsion layers. EP 731 383 claims the use of certain cyan and magenta couplers in the blue-sensitised emulsion layer package and the layers adjacent thereto.

Improved colour reproduction is, however, achieved at the cost of impaired grain.

The object of the invention was accordingly to avoid this disadvantage and to provide a material having very good colour reproduction, elevated sensitivity and low grain.

This object is surprisingly achieved by a colour photographic silver halide material containing, in a layer which is arranged further away from the support than the most highly sensitive, blue-sensitive layer, both at least one yellow coupler and at least one magenta or at least one cyan coupler.

The couplers in the layer above the most highly sensitive, blue-sensitive layer are preferably either 4-equivalent couplers or 2-equivalent couplers having an eliminable group which is photographically inert.

Preferably, the yellow coupler is used in the stated layer in a quantity of 20 to 150 mg/m$^2$, the magenta or cyan coupler in a quantity of 5 to 100 mg/m$^2$.

The present invention accordingly provides a colour photographic silver halide material having at least two blue-sensitive, yellow coupler containing silver halide emulsion layers, at least two green-sensitive, magenta coupler containing silver halide emulsion layers and at least two red-sensitive, cyan coupler containing silver halide emulsion layers together with conventional interlayers and protective layers, wherein photosensitive layers of identical colour sensitivity differ with regard to the photographic sensitivity thereof and the more highly sensitive layers are arranged further away from the support than the less sensitive layers of identical colour sensitivity, characterised in that, in a layer which is arranged further from the support than the most highly sensitive, blue-sensitive layer, the colour photographic material contains both at least one yellow coupler and at least one magenta or cyan coupler.

Depending upon the type of the photographic material, these layers may be differently arranged. This is demonstrated for the most important products:

Colour photographic films such as colour negative films and colour reversal films have on the support, in the stated sequence, 2 or 3 red-sensitive, cyan-coupling silver halide emulsion layers, 2 or 3 green-sensitive, magenta-coupling silver halide emulsion layers and 2 or 3 blue-sensitive, yellow-coupling silver halide emulsion layers.

A yellow filter layer is conventionally located between the green-sensitive and blue-sensitive layers which prevents blue light from penetrating into the underlying layers.

Possible options for different layer arrangements and the effects thereof on photographic properties are described in J. Inf. Rec. Mats., 1994, volume 22, pages 183–193.

The number and arrangement of the photosensitive layers may be varied in order to achieve specific results. For example, all high sensitivity layers may be grouped together in one package of layers and all low sensitivity layers may be grouped together another package of layers in order to increase sensitivity (DE 25 30 645).

The substantial constituents of the photographic emulsion layers are binder, silver halide grains and colour couplers.

Details of suitable binders may be found in Research Disclosure 37254, part 2 (1995), page 286.

Details of suitable silver halide emulsions, the production, ripening, stabilisation and spectral sensitisation thereof, including suitable spectral sensitisers, may be found in Research Disclosure 37254, part 3 (1995), page 286 and in Research Disclosure 37038, part XV (1995), page 89.

Photographic materials with camera sensitivity conventionally contain silver bromideiodide or silver bromide-iodide-chloride emulsions. Photographic print materials contain either silver chloride-bromide emulsions containing up to 80 mol. % of AgBr or silver chloride-bromide emulsions containing above 95 mol. % of AgCl.

Details relating to colour couplers may be found in Research Disclosure 37254, part 4 (1995), page 288 and in Research Disclosure 37038, part 11 (1995), page 80. The maximum absorption of the dyes formed from the couplers and the developer oxidation product is preferably within the following ranges: yellow coupler 430 to 460 nm, magenta coupler 540 to 560 nm, cyan coupler 630 to 700 nm.

In order to improve sensitivity, grain, sharpness and colour separation in colour photographic films, compounds are frequently used which, on reaction with the developer oxidation product, release photographically active compounds, for example DIR couplers which eliminate a development inhibitor.

Details relating to such compounds, in particular couplers, may be found in Research Disclosure 37254, part 5 (1995), page 290 and in Research Disclosure 37038, part XIV (1995), page 86.

Colour couplers, which are usually hydrophobic, as well as other hydrophobic constituents of the layers, are conventionally dissolved or dispersed in high-boiling organic solvents. These solutions or dispersions are then emulsified into an aqueous binder solution (conventionally a gelatine solution) and, once the layers have dried, are present as fine droplets (0.05 to 0.8 $\mu$m in diameter) in the layers.

Suitable high-boiling organic solvents, methods for the introduction thereof into the layers of a photographic material and further methods for introducing chemical compounds into photographic layers may be found in Research Disclosure 37254, part 6 (1995), page 292.

The non-photosensitive interlayers generally arranged between layers of different spectral sensitivity may contain agents which prevent an undesirable diffusion of developer oxidation products from one photosensitive layer into another photosensitive layer with a different spectral sensitisation.

Suitable compounds (white couplers, scavengers or DOP scavengers) may be found in Research Disclosure 37254, part 7 (1995), page 292 and in Research Disclosure 37038, part III (1995), page 84.

The photographic material may also contain UV light absorbing compounds, optical brighteners, spacers, filter dyes, formalin scavengers, light stabilisers, anti-oxidants, Dmin dyes, additives to improve stabilisation of dyes, couplers and whites and to reduce colour fogging, plasticisers (latices), biocides and others.

Suitable compounds may be found in Research Disclosure 37254, part 8 (1995), page 292 and in Research Disclosure 37038, parts IV, V, VI, VII, X, XI and XIII (1995), pages 84 et seq.

The layers of colour photographic materials are conventionally hardened, i.e. the binder used, preferably gelatine, is crosslinked by appropriate chemical methods.

Suitable hardener substances may be found in Research Disclosure 37254, part 9 (1995), page 294 and in Research Disclosure 37038, part XII (1995), page 86.

Once exposed with an image, colour photographic materials are processed using different processes depending upon their nature. Details relating to processing methods and the necessary chemicals are disclosed in Research Disclosure 37254, part 10 (1995), page 294 and in Research Disclosure 37038, parts XVI to XXIII (1995), pages 95 et seq. together with example materials.

EXAMPLES

Example 1

A colour photographic recording material for colour negative colour development was produced (layer structure 1A) by applying the following layers in the stated sequence onto a transparent cellulose triacetate film support. Quantities are stated in each case per 1 $m^2$. The silver halide application rate is stated as the corresponding quantities of $AgNO_3$; the silver halides are stabilised with 0.5 g of 4-hydroxy-6-methyl-1,3,3a, 7-tetraazai per mole of $AgNO_3$.

1st layer (Anti-halo layer)

- 0.3 g of black colloidal silver
- 1.2 g of gelatine
- 0.4 g of UV absorber UV-1
- 0.02 g of tricresyl phosphate (TCP)

2nd layer (Micrate interlayer)

- 0.25 g of $AgNO_3$ of a micrate Ag(Br,I) emulsion, average grain diameter 0.07 μm, 0.5 mol. % iodide
- 1.0 g of gelatine 3rd layer (Low sensitivity, red-sensitive layer)

- 2.7 g of $AgNO_3$ of a spectrally red-sensitised Ag(Br,I) emulsion containing 4 mol. % iodide, average grain diameter 0.5 μm
- 2.0 g of gelatine
- 0.88 g of colourless coupler C-1
- 0.02 g of DIR coupler D-1
- 0.05 g of coloured coupler RC-1
- 0.70 g of TCP 4th layer (High sensitivity, red-sensitive layer)

- 2.2 g of $AgNO_3$ of a spectrally red-sensitised Ag(Br,I) emulsion, 12 mol. % iodide, average grain diameter 1.0 μm
- 1.8 g of gelatine
- 0.19 g of colourless coupler C-2
- 0.17 g of TCP -continued 5th layer (Interlayer)

- 0.4 g of gelatine
- 0.15 g of white coupler W-1
- 0.06 g of aurintricarboxylic acid aluminium salt 6th layer (Low sensitivity, green-sensitive layer)

- 1.9 g of $AgNO_3$ of a spectrally green-sensitised Ag(Br,I) emulsion, 4 mol. % iodide, average grain diameter 0.35 μm
- 1.8 g of gelatine
- 0.54 g of colourless coupler M-1
- 0.24 g of DIR coupler D-1
- 0.065 g of coloured coupler YM-1
- 0.6 g of TCP 7th layer (High sensitivity, green-sensitive layer)

- 1.25 g of $AgNO_3$ of a spectrally green-sensitised Ag (Br,I) emulsion, 9 mol. % iodide, average grain diameter 0.8 μm
- 1.1 g of gelatine
- 0.195 g of colourless coupler M-2
- 0.05 g of colourless coupler YM-2
- 0.245 g of TCP 8th layer (Yellow filter layer)

- 0.09 g of yellow colloidal silver
- 0.25 g of gelatine
- 0.08 g of scavenger SC-1
- 0.40 g of formaldehyde scavenger FF-1
- 0.08 g of TCP 9th layer (Low sensitivity, blue-sensitive layer)

- 0.9 g of a spectrally blue-sensitised Ag(Br,I) emulsion, 6 mol. % iodide, average grain diameter 0.6 μm
- 2.2 g of gelatine
- 1.1 g of colourless coupler Y-1
- 0.037 g of DIR coupler D-1
- 1.14 g of TCP 10th layer (High Sensitivity, blue-sensitive layer)

- 0.6 g of $AgNO_3$ of a spectrally blue-sensitised Ag(Br,I) emulsion, 10 mol. % iodide, average grain diameter 1.2 μm
- 0.6 g of gelatine
- 0.2 g of colourless coupler Y-1
- 0.003 g of DIR coupler D-1
- 0.22 g of TCP 11th layer (Micrate layer)

- 0.06 g $AgNO_3$ of a micrate Ag(Br,I) emulsion, average grain diameter 0.06 μm, 0.5 mol. % iodide
- 1 g of gelatine
- 0.3 g of UV absorber UV-2
- 0.3 g of TCP 12th layer (Protective & hardening layer)

- 0.25 g of gelatine
- 0.75 g of hardener of the formula

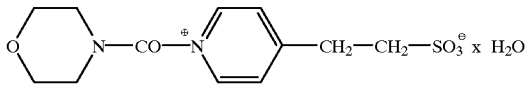

such that, once cured, the overall layer structure has a swelling factor of ≦3.5.

Substances used in Example 1:
UV-1
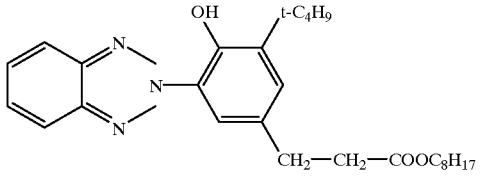
UV-2
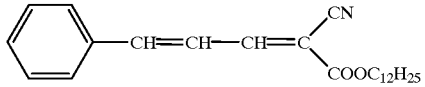
C-1
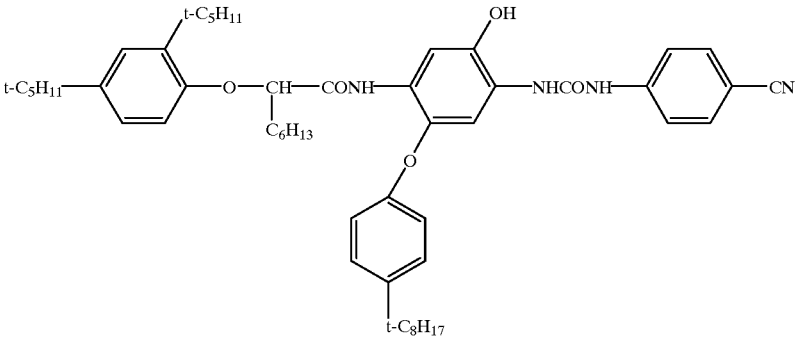
C-2
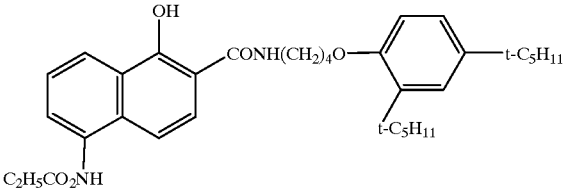
RC-1
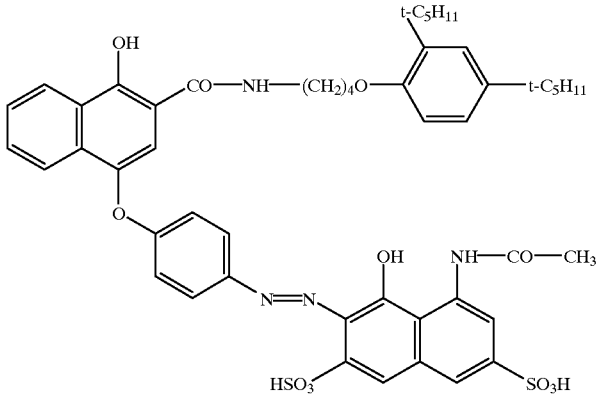

-continued
M-1
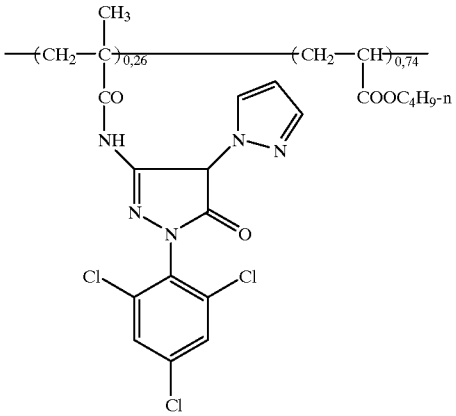
M-2
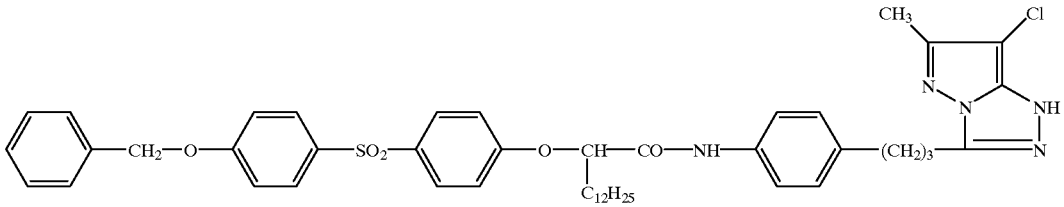
YM-1
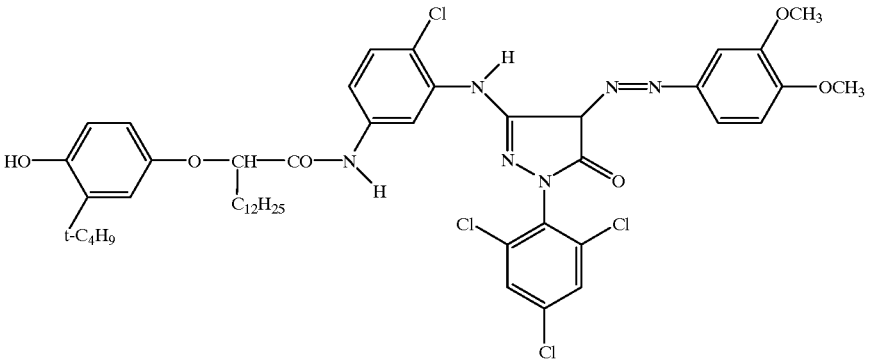
Y-1
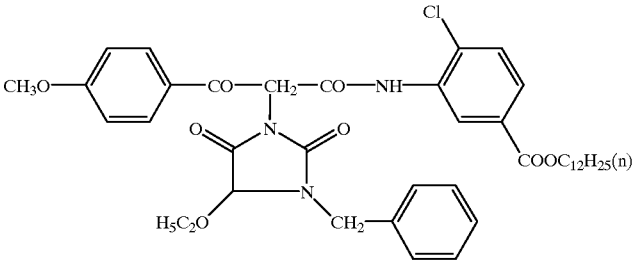
D-1
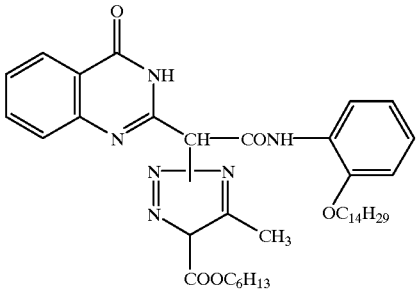

-continued

YM-2

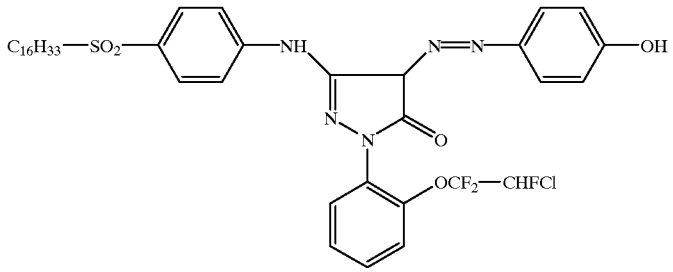

SC-1

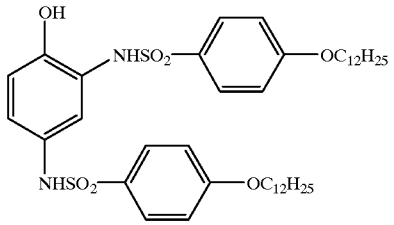

FF-1

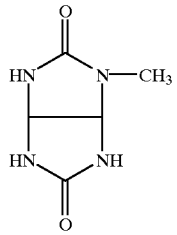

W-1

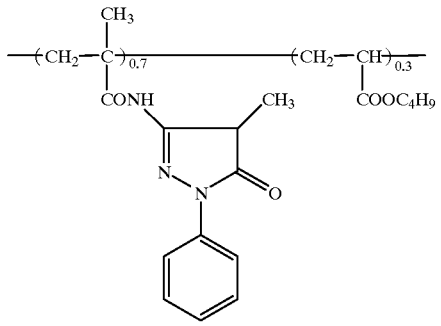

After exposure with a grey wedge, development was performed in accordance with The British Journal of Photography, 1974, pages 597 and 598.

In layer structures 1B to 1G, a quantity of 40 mg/m$^2$ of a cyan coupler and/or a quantity of 75 mg/m$^2$ of a yellow coupler were additionally incorporated into the $11_{th}$ layer. The $10^{th}$ layer in layer structure 1G is of the following composition:

$10^{th}$ layer (High sensitivity, blue-sensitive layer)

| | | |
|---|---|---|
| 0.43 | g | of $AgNO_3$ of a spectrally blue-sensitised Ag(Br,I) emulsion, 10 mol. % iodide, average grain diameter 1.2 $\mu$m |
| 0.5 | g | of gelatine |
| 0.1 | g | of colourless coupler Y-1 |

-continued

| | | |
|---|---|---|
| 0.002 | g | of DIR coupler D-1 |
| 0.1 | g | of TCP |

The compounds and the results are shown in Table 1. Sharpness is determined by exposing the material with a bar pattern of 20 line pairs per mm with a difference in density of 0.6 ($\Delta D_{in}$) in such a manner that the higher negative density is 1.0 above fog. The difference in density ($\Delta D_{out}$) in the negative and gradation (gamma) are measured on the grey wedge exposure. This produces a sharpness value $$\frac{\Delta D_{out}}{(\Delta D_{in} \times \text{gamma})}$$

TABLE 1

| Layer structure | Cyan coupler 9th layer | Cyan coupler 11th layer | Yellow coupler 11th layer | Relative sensitivity, blue | Colour reproduction, skin tone*) | Grain cyan**) | Sharpness cyan | |
|---|---|---|---|---|---|---|---|---|
| 1A | — | — | — | 100 | 8 | 10 | 0.77 | Comparison |
| 1B | C-1 | — | — | 98 | 3 | 12 | 0.82 | Comparison |
| 1C | — | C-1 | — | 102 | 3 | 10 | 0.84 | Comparison |
| 1D | — | C-1 | Y-1 | 110 | 2 | 10 | 0.84 | Invention |
| 1E | — | C-2 | Y-1 | 114 | 2 | 10 | 0.85 | Invention |
| 1F | — | C-3 | Y-1 | 110 | 1 | 10 | 0.82 | Invention |
| 1G | — | C-4 | Y-2 | 105 | 3 | 10 | 0.89 | Invention |

*)Distance ΔE in the CIELAB system in comparison with original ("light skin" field of the Macbeth colour chart, Munsell Color, Baltimore, USA)
**)Grain (RMS) at density 0.6 above fog, values × 1000

Compounds additionally used in Example 1:

C-3

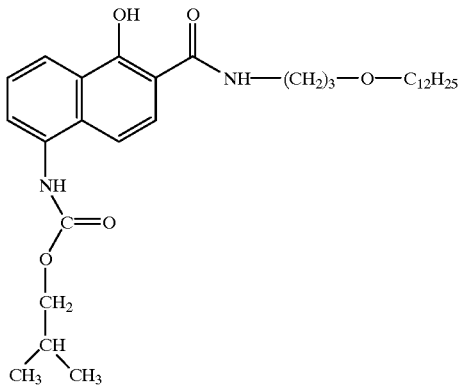

C-4

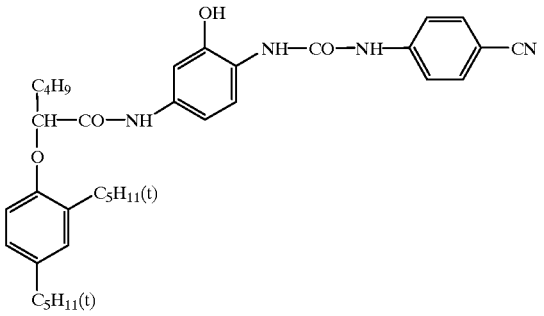

Y-2

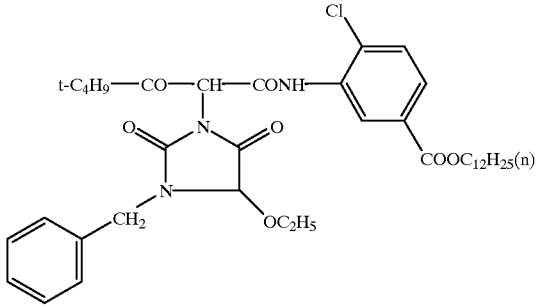

As is evident, in the materials according to the invention there is an improvement in blue sensitivity and reproduction of detail (cyan grain and sharpness) combined with good skin tone reproduction.

Example 2

In contrast to layer structure 1A, the $8_{th}$ layer in layer structure 2A is of the following composition:

| 8th layer (Yellow filter layer) | |
|---|---|
| 0.25 g | of gelatine |
| 0.05 g | of yellow dye GF-1 |
| 0.08 g | of formaldehyde scavenger FF-1 |
| 0.08 g | of TCP |

GF-1

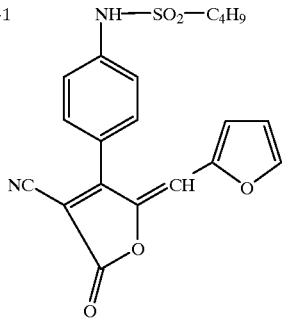

In layer structures 2B to 2E, a quantity of 35 mg/m$^2$ of a magenta coupler and/or a quantity of 100 mg/m$^2$ of a yellow coupler were additionally incorporated into the $11_{th}$ layer. The $10_{th}$ layer in layer structure 2E is of the same composition as in layer structure 1G.

The compounds and results are shown in Table 2.

TABLE 2

| Layer structure | Magenta coupler 9th layer | Magenta coupler 11th Layer | Yellow coupler l 11th layer | Relative sensitivity, blue | Grain cyan**) | Sharpness, magenta | |
|---|---|---|---|---|---|---|---|
| 2A | — | — | — | 100 | 9 | 1,05 | Comparison |
| 2B | M-2 | — | — | 98 | 11 | 1,12 | Comparison |
| 2C | — | M-2 | — | 102 | 9 | 1,14 | Comparison |
| 2D | — | M-2 | Y-1 | 111 | 9 | 1,16 | Invention |
| 2E | — | M-2 | Y-1 | 107 | 9 | 1,22 | Invention |

**)Grain (RMS) at density 0.6 above fog, values × 1000

As is evident, in the materials according to the invention there is an improvement in blue sensitivity and reproduction of detail (magenta grain and sharpness).

We claim:

1. A color photographic silver halide material which comprises a support, at least two blue-sensitive, yellow coupler containing silver halide emulsion layers, at least two green-sensitive, magenta coupler containing silver halide emulsion layers and at least two red-sensitive, cyan coupler containing silver halide emulsion layers together with interlayers and protective layers, wherein photosensitive layers of identical color sensitivity differ with regard to the photographic sensitivity thereof and the more highly sensitive layers are arranged further away from the support than the less sensitive layers of identical color sensitivity, and at least one of said interlayers or said protective layers is arranged further from the support than the most highly sensitive blue-sensitive layer, and at least one said interlayer or protective layer above the most highly blue-sensitive layer contains both at least one yellow coupler and at least one magenta or cyan coupler and wherein the at least one yellow coupler and at least one magenta or cyan coupler in said interlayer or protective layer above the most highly sensitive, blue-sensitive layer are 2-equivalent couplers having photographically inert eliminable group 4-equivalent couplers.

2. The color photographic silver halide material according to claim 1, wherein in the layer which is arranged further away from the support than the most highly sensitive, blue-sensitive layer, the yellow coupler is used in a quantity of 20 to 150 $mg/m^2$ and the magenta or cyan couplers in a quantity of 5 to 100 $mg/m^2$.

* * * * *